United States Patent [19]

Trotter et al.

[11] 4,346,835

[45] Aug. 31, 1982

[54] INSTANTANEOUS WATER HEATER GAS CONTROL VALVE

[76] Inventors: Albin Trotter; Ursus Trotter, both of Karen 2908, Las Cruces, N. Mex. 88001

[21] Appl. No.: 252,218

[22] Filed: Apr. 8, 1981

[51] Int. Cl.[3] ..... F28F 27/00

[52] U.S. Cl. ..... 236/24; 122/448 R; 431/255

[58] Field of Search ..... 236/23, 25 A, 25 R, 236/24; 122/448 R; 137/335, 100; 431/255

[56] References Cited

U.S. PATENT DOCUMENTS

| | | | |
|---|---|---|---|
| 1,330,362 | 2/1920 | Walker | 236/23 |
| 3,258,203 | 6/1966 | Kurz et al. | 236/25 R X |
| 3,490,693 | 1/1970 | Meier | 236/25 X |
| 3,627,202 | 12/1971 | Meier | 236/25 R X |
| 3,770,197 | 11/1973 | Meier | 236/23 X |
| 3,770,363 | 11/1973 | Friedrich | 431/255 X |
| 4,184,457 | 1/1980 | Trotter et al. | 236/23 X |

*Primary Examiner*—William E. Tapolcai, Jr.
*Attorney, Agent, or Firm*—Brisebois & Kruger

[57] ABSTRACT

A multichamber gas control valve modulates and controls the flow of gas to the burner of an instantaneous water heater. Flow of gas from an inlet chamber to a first chamber of the valve is controlled by a thermostatic valve and gas flow from the first to a second chamber is controlled by a temperature controller. Gas flow from the second chamber to an outlet chamber is controlled by a spring biased valve actuated by a diaphragm actuator operated in response to flow of water through a venturi in the water supply of the heater. The several chambers are in a common valve body closed by a removable cover to provide easy access to the components of the assembly.

5 Claims, 3 Drawing Figures

INSTANTANEOUS WATER HEATER GAS CONTROL VALVE

BACKGROUND OF THE INVENTION

This invention relates to an improved modulated control valve for controlling the flow of combustible gas in an instantaneous water heater.

Increased fuel costs and the need to conserve fuel have changed the manner in which a gas fired instantaneous water heater is used. When gas was inexpensive, the pilot flame, once lighted, would not be turned off, except when some maintenance operations were to be performed, or when the heater would not be used for long intervals of time such as weeks or months. Today gaseous fuel is in short supply and is expensive, and it is desirable to turn off the pilot flame where the water heater will not be used for several hours, or overnight.

Further, improved safety considerations require quicker acting and more reliable and positive operation than has been possible with previously used gas modulating valves in instantaneous water heaters. Fast shut off of gas to the burner when the flow of water through the heater is shut off, also saves fuel.

In some prior gas modulating valves, there was a diaphragm valve controlled by several conditions, such as water flow rate and water temperature, and the extent of opening of which was controlled by differential pressure of the combustible gas. While such valves were quite reliable, they were expensive complex, required external control gas connections, and did not have the speeds of operation now required.

In addition, the pilot flames of prior instantaneous water heater gas valves were difficult and time consuming to light.

The object of the present invention is an improved modulated control valve for controlling the flow of the combustible gas in an instantaneous water heater. The modulated control valve of the present invention provides a system much simpler, economical and reliable than the control valve disclosed in U.S. Pat. No. 4,184,457, which was an improvement of the valve of U.S. Pat. No. 3,917,162, which in turn presented an improvement over the control system disclosed in U.S. Pat. No. 3,806,026, all of which are owned by applicants.

SUMMARY OF THE INVENTION

Fundamentally, the improved control valve of the present invention comprises a "venturi" type restrictor, located in the water inlet of the water heater, operating a diaphragm valve which is directly connected to, and controls the opening and closing of the gas flow control valve for feeding gas to the burner of the instantaneous water heater.

Further, in accordance with the invention, there is provided an instantaneous water heater gas flow modulating valve constructed in the form of a single unit which does not require external control gas conduits and has no small gas orifices or precision passages for control of gas flow to the burner.

In addition, the valve according to the invention is easy to service, easy to install as a replacement in existing installations, and includes features which make the pilot easy to light quickly.

It is correspondingly an object of this invention to provide a unique instant water heater control arrangement including a novel control valve assembly which overcomes the shortcomings of the prior valve arrangements.

It is also an object to provide such a control valve assembly in which the main gas valve for controlling the flow of gas to the heater burner is directly operated mechanically by a venturi actuated diaphragm controller operated in response to water flow through the heater.

Another object is a four chamber valve body for housing the valve assembly, and which can be closed with a planar cover wall.

Numerous other objects, features, and advantages of the invention will become apparent from the drawings which form a part of this specification.

DETAILED DESCRIPTION OF PREFERRED EMBODIMENT

Figure 1:
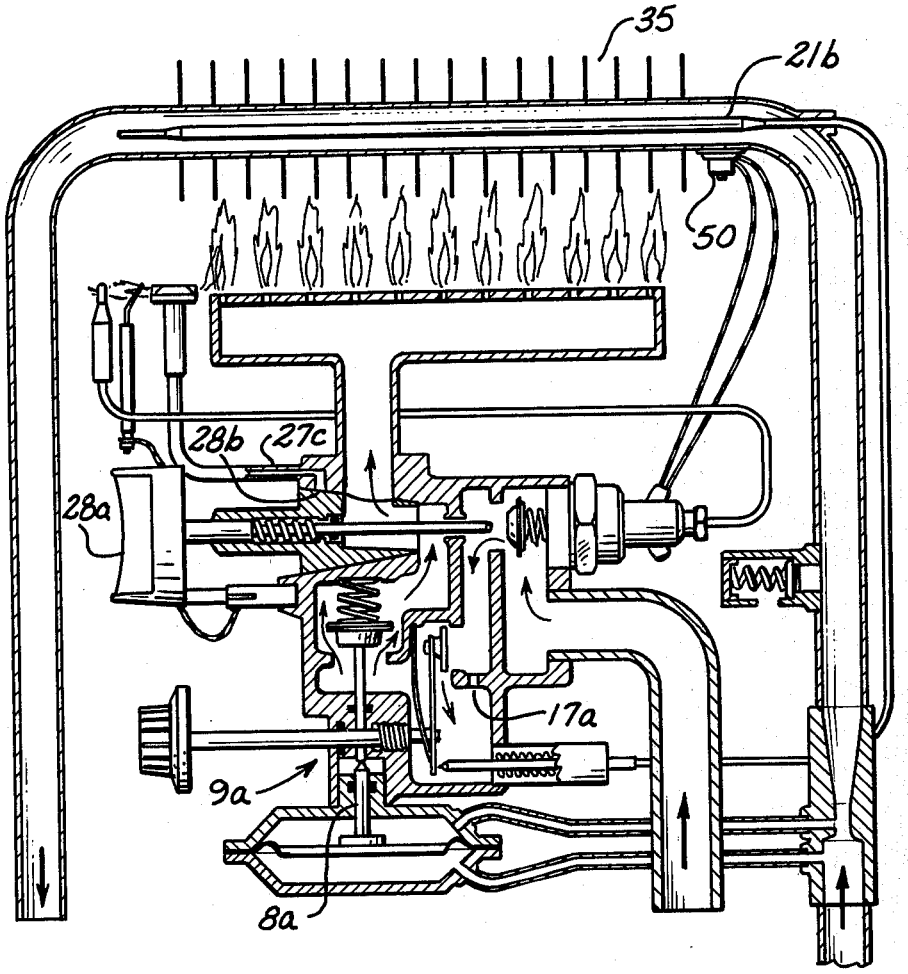
FIG. 1 is a schematic view of an instant water heater control system according to the invention.
Figure 2:
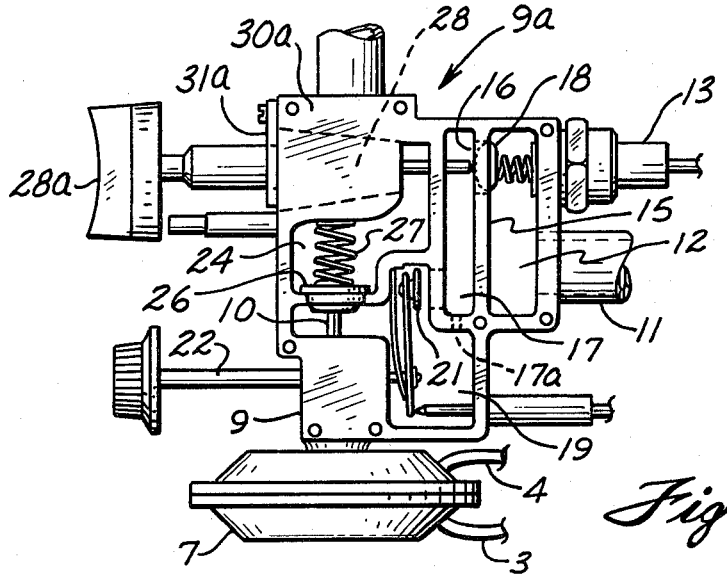
FIG. 2 is a front view of the gas valve assembly with its cover plate removed.

FIG. 1 shows an instant water heater system including the valve assembly of the invention. As shown in FIG. 1, in the water inlet duct 1 of the water heater is inserted a "venturi" restrictor 2 having a pressure duct 3 and a suction duct 4 connected respectively to the first and second chambers 5 and 6 of a diaphragm actuator 7. The first and second chambers 5, 6 (lower and upper chambers, respectively, when the valve assembly is oriented as shown in FIGS. 1 and 2) are separated by a resilient diaphragm 8 made of an elastomeric material.

The diaphragm actuator 7 is mounted in the bottom portion of a gas control valve assembly 9*a*, and a rod 8*a* fixed to the resilient diaphragm 8 projects into the body 9 of the control valve assembly 9*a*. The body 9 of the gas control valve assembly 9*a* comprises a cast or molded box like casing internally partitioned into four chambers. These chambers are, an inlet chamber 12, a first intermediate chamber 17, a second intermediate chamber 19, and an outlet chamber 24.

Figure 3:
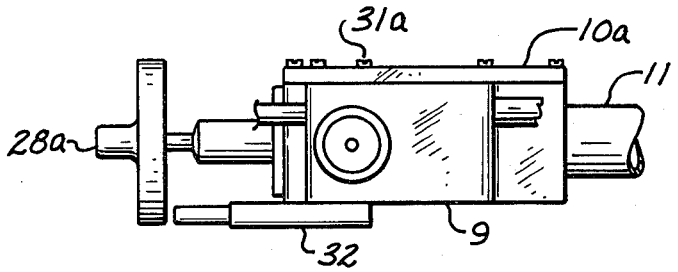
FIG. 3 is a bottom view of the valve assembly with the diaphragm actuator removed.

To provide easy accesss to the component elements of the valve assembly 9*a*, and to facilitate assembly and service of the assembly valve, the body 9 is provided with at least one removable planar cover or wall 10*a* (FIG. 3). A gas inlet duct 11 is connected to the inlet chamber 12 which is provided with a conventional electromagnetic safety valve 13 controlled by a thermocouple 14 located adjacent to the pilot flame unit 29. A partition 15 having an opening 16 separates the inlet chamber 12 from the first intermediate chamber 17. The opening 16 in partition 15 provides a seat for the valve element 18 of the electromagnetic valve 13.

The first intermediate chamber 17 is connected to a second intermediate chamber 19 through an opening 20 that is provided with a spring biased valve element 21 that is pivotally connected to, and setable by a heat controller screw 22 that is manually rotatable by means of a knob 23. A thermostatic control pin 21*a* activated by a thermostatic bulb 21*b*. directly operates the valve element 21 thus automatically controlling and modulating the flow of gas to chamber 19.

Second intermediate chamber 19 is connected to the final or outlet chamber 24 by an opening 25 that is closable by a valve disc 26 that is mounted on the end of a rod 10 which is moved axially by the resilient diaphragm 8 of the actuator 7, and is biased to a closed position by a helical compression spring 27. Between the first and second intermediate chambers 17, 19 a small opening 17*a* is provided for allowing the "minimum flame" gas flow to the main burner 30 when the valve element 21 is closed and valve disc 26 is open.

The outlet chamber 24 contains a cone gas valve 28 manually rotatable between two extreme positions, fully closed and open, with an intermediate position for lighting the pilot flame unit 29. Cone valve 28 has the usual partial annular recess 28*b* which, in a range of positions between fully open and the pilot flame lighting position, connects a pilot flame gas flow passage 27*a* to a passage (not shown) formed in body 9 which communicates with chamber 17, to provide the gas flow required for lighting the pilot flame unit 29. When cone valve 28 is rotated to the pilot flame position, from its closed position, an operating pin 31 forces the valve element 18 of the safety valve 13 to an open position so that gas glows into chamber 17, and then to the pilot flame unit 29 via the body passage, annular recess 28*b*, and flow passages 27*a*. Also, when knob 28*a* is pressed, a piezoelectric-device 32 is engaged by and actuated by the knob to cause spark plug 33 to produce a spark for lighting the pilot flame unit 29. The thermocouple 14, when heated by the pilot flame, maintains safety valve 13 open, after knob 28*a* is released thus retracting operating pin 31.

FIG. 2 shows the control valve assembly 9*a* with its planar cover 10*a* removed. The body 9 presents a planar surface 30*a* on at least one side, and is closed by the cover 10*a*, in the form of a flat plate, which is fastened to the body with screws 31*a*. A gasket (not shown) is interposed between the cover plate 10*a* and the planar surface 30*a* of body 9. As is evident with reference to FIG. 2, when cover plate 10*a* is removed, access is provided to the several chambers within the body for servicing and replacing the several valve elements within the body. This arrangement also facilitates assembly by providing access to the chamber in which valve 21 is located so that this valve and its spring and arm can easily be mounted on the end of the adjusting screw 22.

The cone valve 28 is advantageously held in position in the valve body by a removable retainer plate 31*a*. Cone valve 28 can be withdrawn axially from its conical seat, after retainer plate 31*a* is removed.

As shown at FIG. 3, the piezoelectric device 32 can be mounted directly on the rear wall of body 9 in an appropriate position to be engaged by the rear face of knob 28*a*, and thus to be actuated when the knob is depressed.

Conventionally, the water heater is provided with a conventional pressure relief valve S which is located downstream of the venturi-restrictor 2.

OPERATION

The operation of the heater and the improved gas control valve assembly 9 will now be described with reference to FIGS. 1 and 2. It will be noted that FIG. 1 shows the various valve elements of the valve assembly in their operating positions when the main burner 30 is on, and water is flowing through the heater. On the other hand, FIG. 2 shows the position of the various elements of the valve assembly when the cone valve 28 is in its fully closed position, and no water is flowing through the heater. As shown at FIG. 2, in this condition, valve element 18 closes opening 16 and there is no flow of gas from first chamber 12 into the valve. Control valve 21 is wide open because the heater is cold, and the burner valve element 26 is closed under the action of its spring 27 because the pressure in chambers 5 and 6 of the diaphragm actuator 7 is the same.

The improved gas control valve of the invention operates as follows:

(a) Combustible gas from inlet duct 11 fills inlet chamber 12.

(b) To light the pilot flame unit 29, knob 28*a* is rotated to turn cone valve 28 to the pilot flame light intermediate position, and the knob is depressed to unseat valve element 18 and to actuate piezoelectric device 32 to create a spark at spark plug 33. When valve element 18 is unseated, gas flows into first intermediate chamber 17, and via the passage in the body, the annular recess 28*b* in cone valve 28, and passage 27*a*, gas flows to the pilot flame unit 29.

(c) When the pilot flame unit 29 is lighted, thermocouple 14 is heated, and generates a current which maintains open, the valve element 18 of the safety valve 13. The knob 28*a* can then be released while safety valve 13 stays open.

(d) Because the thermostatically controlled valve 21 is normally open, gas flows to second intermediate chamber 19. When the water is turned on by opening a hot water outlet valve downstream of the heater, there is flow of water through venturi-restrictor 2 and the heat exchanger 35. The water flowing through the venturi-restrictor 2 produces a pressure reduction in duct 4 and a relative pressure increase in duct 3 and bottom chamber 5 of the diaphragm actuator 7, forcing the resilient diaphragm 8 and the valve disc 26 fixed to the rod 10 against the spring 27 thus allowing the flow of gas to the outlet chamber 24 and, through the gas cone valve 28 (when the valve is in the fully open position) into the main gas burner 30 where the gas is ignited by the pilot flame at unit 29.

(e) When the flow of water through the venturi-restrictor 2 is decreased due to any reason, the pressure in duct 4 increases and the pressure in duct 3 decreases thus allowing the spring means 27 to force the valve disc 26 downwardly to reduce the gas flow to the outlet chamber 24 and the main burner 30, thus reducing the size of the flames 34 and the amount of heat provided to the heat exchanger 35. In this manner the temperature of the hot water is maintained within a certain range which is controlled by the thermostatic system composed of valve element 21, thermostatic bulb 21*b*, and control pin 21*a*.

(f) Thermostatic bulb 21*b* actuates pin 21*a* in accordance with the precise water temperature to be maintained, by modulating the extent of the opening of the valve element 21. If the water temperature exceeds the temperature preset by adjusting screw 22, valve 21 closes. However, opening 17*a* in the partition between first intermediate chamber 17 and second intermediate chamber 19 continues to provide the minimum gas flow required to keep the main burner lighted. This prevents popping of the flame which could occur if the gas flow to the burner was cut off momentarily by closing of valve element 21 and then immediately reopening it.

(g) In the event that the flow of water through the venturi-restrictor 2 is reduced to an amount below a predetermined minimum flow, or if the water flow is turned off, the pressure in the chambers 6, 5 is equalized and the valve disc 26 is seated on the opening 25 by the action of the spring 27, thus instantly interrupting the flow of gas to the main burner 30, and turning off the burner.

(h) During normal operation of the instant water heater, thermocouple 14 maintains open, the valve element 18 of safety valve 13. Mounted on heat exchanger 35 is a high temperature safety switch 50 which is electrically connected in series with thermocouple 14 and safety valve 13. When the temperature of the heat exchanger where switch 50 is located, exceeds a predetermined temperature, for example 90° C., the normally closed switch 50 opens thereby breaking the circuit to the safety valve so that the safety valve quickly closes to shut-off all gas flow to the main burner 30.

As explained above, the diaphragm actuator 7 directly mechanically actuates the closure disc 26 of the main burner valve to maintain the water temperature in a predetermined range. The precise temperature of the water is then controlled by the action of valve element 21 under the control of thermobulb **21*b* and control pin 21*a*, and the temperature of the water can be adjusted by manipulating screw 22. This combined action of valve element 21 and valve disc 26** provides precise and rapid control of the water temperature, and also assures that the flow of gas to the main burner is completely cut off when there is no flow of water through the instant water heater.

The piezoelectric device 32 and spark plug 14 in combination with knob **28*a* permit immediate and effortless lighting of the pilot flame. Thus, the user of the heater will be in no way inconvenienced by turning off the pilot flame for even short periods of time such as a few hours and can thus save the gas normally consumed by the pilot flame. Further, by virtue of the thermocouple 33 and electromagnetic safety valve 13, the user need only maintain knob 28*a* depressed for several seconds to light the pilot flame and maintain valve element 18 of the safety valve retracted as a result of the output of the thermocouple 14**.

While a preferred embodiment has been shown and described, it is to be understood that numerous changes can be made without departing from the scope of the invention as set forth herein and in the appended claims.

What is claimed is:

1. An improved water operated control valve for controlling and modulating the flow of gas to the burner of an instantaneous water heater, the control valve comprising a water controlled diaphragm actuator, and a multi-chamber gas valve assembly comprising a spring-biased valve means operated by a rod connected to a resilient diaphragm of the water controlled actuator and which separates the actuator into first and second chambers, said chamber being fluid connected respectively to the throat and inlet of a venturi-restrictor inserted in the water inlet duct of the water heater, and wherein the gas valve assembly comprises an inlet chamber connected to a gas duct, a first intermediate chamber connected to the inlet chamber by means of a thermostatic valve, a second intermediate chamber connected to the first intermediate chamber through a gas flow limiter operated by a settable temperature controller, and an outlet chamber separated from the second intermediate chamber by said spring biased valve means operated by the rod connected to the diaphragm of the water controlled actuator.

2. An improved control valve as claimed in claim 1, wherein the gas valve assembly comprises a body with at least one planar cover, said cover being removable from the valve body to provide easy access to the interior of the gas valve assembly.

3. An improved control valve according to claim 1, further comprising piezoelectric means mounted on a body of the valve assembly at a location to be actuated by depression of a knob of a manual main gas flow valve, to produce a spark at a spark device adjacent a pilot flame unit of the heater, so that the pilot flame unit can be easily lighted.

4. An improved control valve according to claim 1 wherein said inlet chamber, first, and second intermediate chambers, and said outlet chamber comprise chambers of a common valve body.

5. An improved control valve according to claim 4 wherein said water controlled actuator is mounted on said valve body.

* * * * *